US010694815B2

(12) United States Patent
Bell

(10) Patent No.: US 10,694,815 B2
(45) Date of Patent: Jun. 30, 2020

(54) FOOTWEAR UPPERS AND OTHER TEXTILE COMPONENTS INCLUDING REINFORCED AND ABUTTING EDGE JOINT SEAMS

(71) Applicant: NIKE, Inc., Beaverton, OR (US)

(72) Inventor: Thomas G. Bell, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 190 days.

(21) Appl. No.: 15/802,953

(22) Filed: Nov. 3, 2017

(65) Prior Publication Data

US 2018/0049517 A1 Feb. 22, 2018

Related U.S. Application Data

(62) Division of application No. 13/720,313, filed on Dec. 19, 2012, now Pat. No. 9,833,041, which is a division of application No. 12/239,986, filed on Sep. 29, 2008, now Pat. No. 8,347,438.

(51) Int. Cl.
*A43B 23/02* (2006.01)
*A41D 27/24* (2006.01)
(Continued)

(52) U.S. Cl.
CPC ..... *A43B 23/025* (2013.01); *A41D 27/24* (2013.01); *A43B 1/04* (2013.01); *A43B 9/00* (2013.01);
(Continued)

(58) Field of Classification Search
CPC . A43B 23/02; A43B 23/0235; A43B 23/0245; A43B 23/025; A43B 23/0255; A43B 23/0295; A41D 27/24
(Continued)

(56) References Cited

U.S. PATENT DOCUMENTS 5,253,434 A 10/1993 Curley, Jr. et al.
5,698,056 A * 12/1997 Kamiyama ..... B29C 65/5042 138/98
(Continued)

FOREIGN PATENT DOCUMENTS

CN 101237788 A 8/2008
DE 19917369 A1 10/2000
(Continued)

OTHER PUBLICATIONS

Feb. 5, 2010—(WO) ISR & WO—App. No. PCT/US09/057295.

*Primary Examiner* — Sharon M Prange
(74) *Attorney, Agent, or Firm* — Banner & Witcoff, Ltd.

(57) ABSTRACT

Textile Components, such as upper members for articles of footwear, include: (a) a first portion having a first edge, wherein the first edge includes a first portion of material engaged with a first seam support material via a first thermoplastic material; (b) a second portion having a second edge, wherein the second edge includes a second portion of material engaged with a second seam support material via a second thermoplastic material; and (c) structure to engage the first and second edges in an abutting edge joint (such as a zig-zag stitch). The resulting textile components may be lightweight and breathable (e.g., due to use of lightweight upper fabric), having a comfortable fit (e.g., due to the abutting edge joint), while still providing a strong, stable, and durable construction (e.g., due to the presence of the seam support member(s)).

20 Claims, 14 Drawing Sheets

(51) Int. Cl.

| | |
|---|---|
| ***A43B 1/04*** | (2006.01) |
| ***A43D 111/00*** | (2006.01) |
| ***A43B 23/04*** | (2006.01) |
| ***A43B 9/00*** | (2006.01) |

(52) U.S. Cl.
CPC ..... *A43B 23/0235* (2013.01); *A43B 23/0255* (2013.01); *A43B 23/0295* (2013.01); *A43B 23/04* (2013.01); *A43B 23/042* (2013.01); *A43D 111/00* (2013.01)

(58) Field of Classification Search
USPC ..... 36/45, 57, 58; 12/146 C, 146 CK; 428/61; 112/418
See application file for complete search history.

(56) References Cited

U.S. PATENT DOCUMENTS

| | | | | |
|---|---|---|---|---|
| 5,933,897 | A | 8/1999 | MacDonald | |
| 6,205,683 | B1 | 3/2001 | Clark et al. | |
| 6,557,274 | B2 | 5/2003 | Litchfield et al. | |
| 6,797,352 | B2 | 9/2004 | Fowler | |
| 7,047,668 | B2 * | 5/2006 | Burris | A43B 5/02 36/133 |
| 7,111,327 | B1 * | 9/2006 | Blauer | A41D 3/04 2/82 |
| 7,291,236 | B2 | 11/2007 | Guilhem et al. | |
| 7,637,032 | B2 | 12/2009 | Sokolowski et al. | |
| 7,704,579 | B2 * | 4/2010 | Brewer | A41D 27/245 428/61 |
| 2006/0165939 | A1 * | 7/2006 | Hottner | A41D 27/24 428/57 |
| 2007/0022627 | A1 * | 2/2007 | Sokolowski | A43B 1/04 36/3 A |

FOREIGN PATENT DOCUMENTS

| | | | |
|---|---|---|---|
| EP | 0976337 | A1 | 2/2000 |
| EP | 1173327 | A2 | 1/2002 |
| FR | 2577764 | A1 | 8/1986 |
| WO | 8802604 | A1 | 4/1988 |

* cited by examiner

FOOTWEAR UPPERS AND OTHER TEXTILE COMPONENTS INCLUDING REINFORCED AND ABUTTING EDGE JOINT SEAMS

RELATED APPLICATION DATA

This application is a divisional of U.S. patent application Ser. No. 13/720,313, filed Dec. 19, 2012, in the name of Thomas G. Bell and entitled "Footwear Uppers and Other Textile Components Including Reinforced and Abutting Edge Joint Seams", which is a divisional application of U.S. patent application Ser. No. 12/239,986, filed Sep. 29, 2008 in the name of Thomas G. Bell and entitled "Footwear Uppers and Other Textile Components Including Reinforced and Abutting Edge Joint Seams", which issued as U.S. Pat. No. 8,347,438 on Jan. 8, 2013. Each of the prior applications is entirely incorporated herein by reference.

FIELD OF THE INVENTION

This invention relates generally to features of textile components (e.g., upper members for articles of footwear) and articles of manufacture (e.g., articles of footwear) produced including such textile components. Such features may include features of the textile component construction and seams used in making the textile components.

BACKGROUND

Conventional articles of athletic footwear have included two primary elements, namely an upper member and a sole structure. The upper member provides a covering for the foot that securely receives and positions the foot with respect to the sole structure. In addition, the upper member may have a configuration that protects the foot and provides ventilation, thereby cooling the foot and removing perspiration. The sole structure generally is secured to a lower portion of the upper member and generally is positioned between the foot and the ground. In addition to attenuating ground or other contact surface reaction forces, the sole structure may provide traction and control foot motions, such as pronation. Accordingly, the upper member and sole structure operate cooperatively to provide a comfortable structure that is suited for a variety of ambulatory and athletic activities, such as walking and running.

The sole structure of athletic footwear generally exhibits a layered configuration that includes a comfort-enhancing insole, a resilient midsole formed from a polymer foam material, and a ground-contacting outsole that provides both abrasion-resistance and traction. The midsole is the primary sole structure element that attenuates ground reaction forces and controls foot motions. Suitable polymer foam materials for the midsole include ethylvinylacetate or polyurethane that compress resiliently under an applied load to attenuate ground reaction forces.

Footwear construction and production typically involve various competing interests. For example, if one uses a fabric for the upper that is heavy and strong enough to provide sufficient durability and structural support for all of the necessary stitching and seams, the fabric tends to be heavy, dense, stiff, and non-breathable. Lightweight fabrics, on the other hand, while often providing the desired breathability characteristics, tend to be insufficiently durable and unable to adequately support seams necessary for forming a durable, long lasting upper member. Lightweight and breathable upper constructions that provide a high level of foot comfort and a stable and durable upper construction would be welcome in this art.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to textile components that include: (a) a first material element having a first edge, wherein the first edge includes a first portion of material engaged with a first seam support material via a first thermoplastic material; (b) a second material element having a second edge, wherein the second edge includes a second portion of material engaged with a second seam support material via a second thermoplastic material, wherein the second thermoplastic material may be the same as or different from the first thermoplastic material, and wherein the second seam support material may be the same as or different from the first seam support material; and (c) means for engaging the first edge and the second edge in an abutting edge joint.

Some more specific aspects of this invention relate to features of upper members for articles of footwear. Upper members in accordance with at least some examples of this invention may include: (a) a first upper portion having a first edge, wherein the first edge includes a first portion of upper material engaged with a first seam support material via a first thermoplastic material; (b) a second upper portion having a second edge, wherein the second edge includes a second portion of upper material engaged with a second seam support material via a second thermoplastic material, wherein the second thermoplastic material may be the same as or different from the first thermoplastic material, and wherein the second seam support material may be the same as or different from the first seam support material; and (c) means for engaging the first edge and the second edge in an abutting edge joint. The means for engaging may include producing a seam by sewing or stitching (such as via a zig-zag stitch), fusing techniques (e.g., using heat, pressure, laser radiation, radio frequency, etc.), mechanical connectors, etc. An abutting edge joint is desirable because it provides a non-overlapping joint, which provides a smooth and comfortable surface for contacting the wearer's foot.

The material for the upper or other textile components may include any desired materials, including conventional materials for upper members as are known and used in the art. In some examples of this invention, the material will constitute a lightweight, breathable fabric, such as a spacer mesh material. In some instances, fabric materials will be selected that are not, by themselves, capable of stably supporting a sewn seam (e.g., the stitches of the seam will tend to easily pull through or tear the fabric thereby separating the seam), for example, thin or lightweight fabrics that provide excellent breathability but are not particularly strong. As another example, if desired, the upper material may include high strength threads or other reinforcing and/or shape defining structures at selected locations in the upper material construction (such as the high strength thread used in various FLYWIRE™ footwear products available from NIKE, Inc. of Beaverton, Oreg., heel counters, etc.).

The seam support material may be any desired material capable of supporting a seam, such as leather, synthetic leather, suede, non-woven materials (such as Ecsaine® an ultra-microfiber, suede-like, non-woven fabric material commercially available from Toray Industries, Inc.), thick textile fabric materials, etc. While strong and capable of supporting a seam, the seam support material is not necessarily very abrasion resistant or breathable.

The thermoplastic material is used to bond the seam support material to the upper or other textile material. The thermoplastic material may constitute a thermoplastic film material that is first applied to the seam support material and optionally cut to a desired shape (along with the seam support material). The thermoplastic film material may be adhered to the seam support material, for example, via an adhesive. The combined thermoplastic film material and seam support material (also called a "seam support member" herein) then may be applied to the upper or other textile material at a desired location (e.g., so that edges of the seam support member are layered with corresponding edges of the upper or other textile material). The layered materials then are treated (e.g., under heat, pressure, ultrasound, and/or radiation exposure conditions) to essentially bind (or "weld") the seam support material to the upper or other textile material via the thermoplastic material. Some specific examples of thermoplastic materials that may be used in such constructions include thermoplastic seam tapes and Sewfree® thermoplastic materials available from Bemis Associates, Inc.

If desired, in accordance with at least some examples of this invention, the seam support material itself may have adhesive properties (e.g., such as a thermoplastic material) that allow it to be directly engaged with the upper or other textile material (e.g., using heat and/or pressure treatments) without the need for an additional separate thermoplastic layer (e.g., a separate thermoplastic film as described above).

Aspects of this invention further relate to articles of manufacture (such as footwear) including textile components (such as upper members) of the types described above and to methods of making seams, textile components, upper members, articles of manufacture, and articles of footwear utilizing one or more abutting edge joints as described above. Footwear uppers in accordance with at least some examples of this invention may provide a lightweight and breathable upper construction (e.g., due to the use of lightweight and breathable upper fabric materials), having a comfortable fit (e.g., due to the abutting edge joint structure), while still having a strong, stable, and durable construction (e.g., due to the presence of the seam support member(s)) and/or an interesting aesthetic appearance (e.g., due to patterns and features of the seam support material on the remainder of the upper material).

BRIEF DESCRIPTION OF THE DRAWINGS

A more complete understanding of the present invention and certain advantages thereof may be acquired by referring to the following detailed description in consideration with the accompanying drawings, in which.

Figure 1:
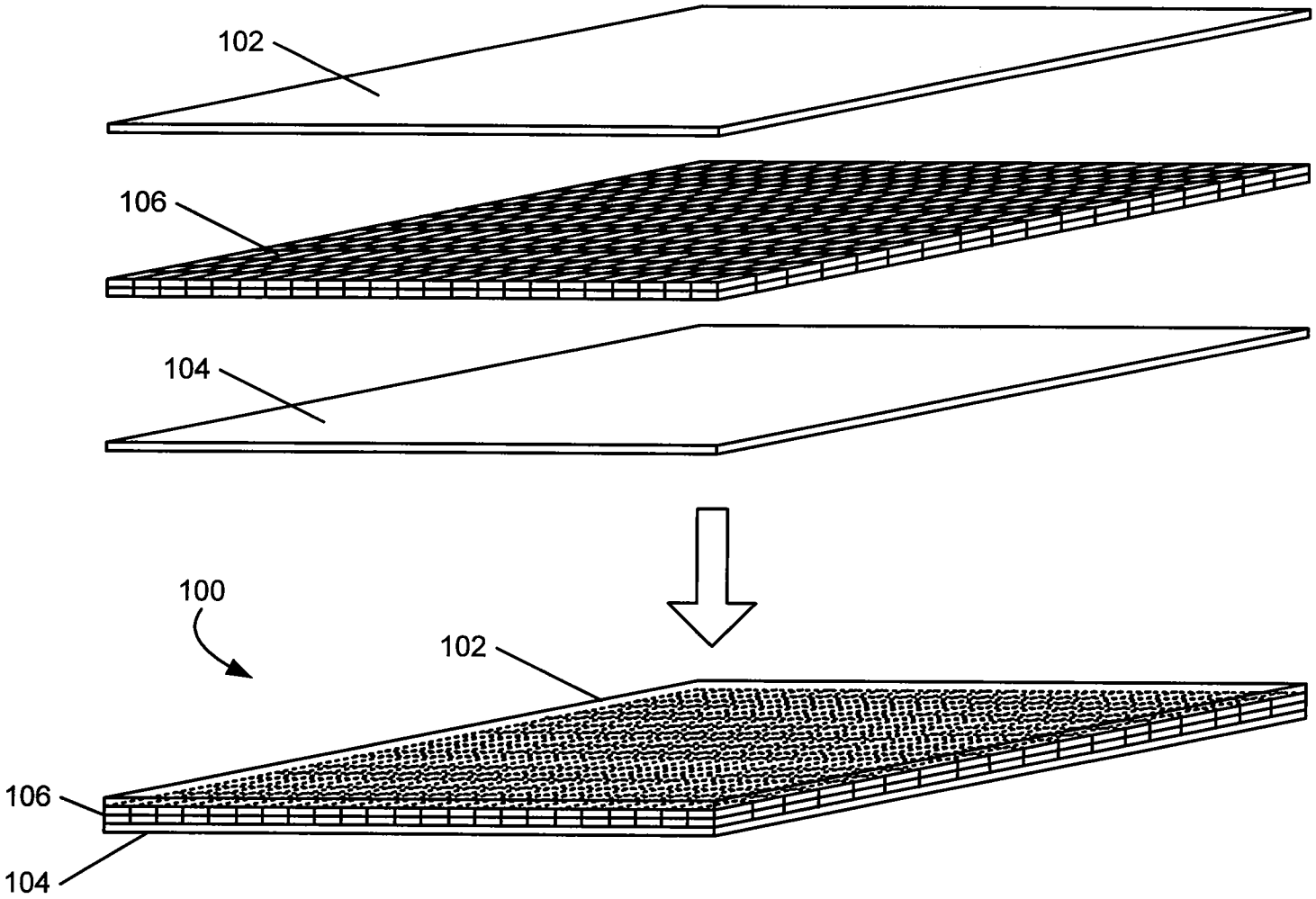
FIG. 1 illustrates construction of an example spacer mesh upper material that may be used in at least some examples of this invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example seams, joints, upper members, and footwear structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

In general, as described above, aspects of this invention relate to textile elements, such as upper members for articles of footwear, including seam structures used in forming products from such textile materials. Specific examples of the invention are described in more detail below. The reader should understand that these specific examples are set forth merely to illustrate examples of the invention, and they should not be construed as limiting the invention.

A. General Description of Aspects of this Invention

1. Upper Structures and Other Textile Components

As noted above, in general, aspects of this invention relate to features of textile components, such as upper members for articles of footwear. Such textile components may include: (a) a first material element having a first edge, wherein the first edge includes a first portion of material engaged with a first seam support material via a first thermoplastic material; (b) a second material element having a second edge, wherein the second edge includes a second portion of material engaged with a second seam support material via a second thermoplastic material, wherein the second thermoplastic material may be the same as or different from the first thermoplastic material, and wherein the second seam support material may be the same as or different from the first seam support material; and (c) means for engaging the first edge and the second edge in an abutting edge joint. The means for engaging the first edge and the second edge may include various structures, such as a sewn seam (e.g., having a zig-zag stitch structure). Optionally, if desired, the thread material of the sewn seam may be at least partially melted, absorbed, concealed, or masked. The thermoplastic materials may be integrally included as part of the seam support materials or they may be separately applied to the seam support materials (e.g., as a thermoplastic film).

Footwear upper members in accordance with at least some examples of this invention may include: (a) a first upper portion having a first edge, wherein the first edge includes a first portion of upper material engaged with a first seam support material via a first thermoplastic material; (b) a second upper portion having a second edge, wherein the second edge includes a second portion of upper material engaged with a second seam support material via a second thermoplastic material (the second thermoplastic material may be the same as or different from the first thermoplastic material and the second seam support material may be the same as or different from the first seam support material); and (c) means for engaging the first edge and the second edge in an abutting edge joint. The means for engaging may include producing a seam by sewing or stitching (such as via a zig-zag stitch), fusing techniques (e.g., using heat, pressure, ultrasonic radiation, laser radiation, radio frequency energy, etc.), mechanical connectors, adhesives, etc. If desired, the thread material used in making the sewn or stitched seam (e.g., the thread of the zig-zag stitch) may be made from a suitable material such that it can be at least partially melted, absorbed, concealed, or masked in the final seam structure. For example, if desired, the thread material may be made from a thermoplastic polyurethane material that can be essentially melted into another material of the abutting edge joint (such as the seam support material) by application of one or more of heat, pressure, laser radiation, radio frequency energy, etc.

The upper member or other textile element may be made from one or more separate pieces without departing from this invention. Similarly, the various parts of the abutting edge joint may be located on a single piece of material or on separate pieces of material without departing from this invention. If desired, when used as an upper material, the upper material also may form at least a portion of the footbed for an article of footwear. In some example structures according to this invention, however, at least one of the first upper portion or the second upper portion may be engaged with a strobel member that forms at least a portion of a footbed for an article of footwear. Additionally or alternatively, if desired, either or both of the first upper portion or the second upper portion may include a piece of material positioned and arranged to be used as a tongue member for the article of footwear in the finally assembled upper member.

The material elements used in forming seams in accordance with this invention may have a variety of properties and characteristics. For example, a major component of the upper or textile element may be a lightweight and highly air permeable material that is not necessarily strong enough to reliably support a seam, whereas the seam support material (e.g., prior to applying a thermoplastic material thereto) that is applied to the major component of the upper or textile element may have higher strength properties (e.g., a high tear strength). In some example constructions in accordance with this invention, the major component of the upper or textile element will include a fabric or textile having an air permeability characteristic (as measured by ASTM D737-96) of at least 15 cubic feet/min/square foot, and in some example structures the air permeability of this element will be at least 30 cubic feet/min/square foot, at least 60 cubic feet/min/square foot, or even at least 100 cubic feet/min/square foot. The seam support material, on the other hand, may have an air permeability characteristic that is at least 25% less, and in some examples at least 50% less or even at least 75% less than that of the more air permeable component of the upper or textile element to which it is engaged.

As another example, in some seam structures in accordance with this invention, the major component of the upper or textile element will include a fabric or textile having a weight of less than 10 oz/yd$^2$, and in some example structures the weight of this element will be less than 7.5 oz/yd$^2$, less than 5 oz/yd$^2$, or even less than 3 oz/yd$^2$. The seam support material, on the other hand, may have a weight characteristic that is at least 25% more, and in some examples at least 50% more, at least 75% more, at least 100% more, or even at least 150% more than that of the lighter weight component of the upper or textile element to which it is engaged.

As another characteristic, if desired, the major component of the upper or textile element may include a fabric or textile having a tear strength characteristic (as measured by ASTM D2261) of less than 15 lbs, and in some example structures the tear strength of this element will be less than 10 lbs, less than 7 lbs, less than 5 lbs, or even less than 3 lbs. The seam support material, on the other hand, may have a tear strength that is at least 25% more, and in some examples at least 50% more, at least 75% more, at least 100% more, or even at least 150% more than that of the component of the upper or textile element to which it is engaged.

Additional potential structural features and specific examples of upper members in accordance with examples of this invention will be described in more detail below.

2. Articles of Footwear

Additional aspects of this invention relate to articles of footwear that incorporate upper members of the types described above. As more specific examples, articles of footwear according to at least some examples of this invention may include: (a) an upper member composed of one or more upper pieces, wherein the upper member includes at least one seam made from a first edge of the upper member engaged with a second edge of the upper member in an abutting edge joint, wherein the first edge of the upper member includes a first portion of upper material engaged with a first seam support material via a first thermoplastic material, wherein the second edge of the upper member includes a second portion of upper material engaged with a second seam support material via a second thermoplastic material (the second thermoplastic material may be the same as or different from the first thermoplastic material and the second seam support material may be the same as or different from the first seam support material); and (b) a sole structure engaged with the upper member. As also described above, the upper member may include a strobel member, a tongue portion, and the like, including any of the features or characteristics described above or described in more detail below.

Any desired sole structure construction may be used without departing from this invention. For example, the sole structure may include one or more of: an insole element or a sock liner (in addition to or as a replacement for the strobel member mentioned above); a midsole member (e.g., made from polyurethane or ethylvinylacetate foams, including fluid-filled bladders, including impact force attenuating columns, including other impact force attenuating elements or structures, etc.); an outsole member engaged with the midsole member; etc. The sole structure may be engaged with the upper member in any desired manner without departing from this invention, including through the use of engagement techniques that are conventional, known, and used in the art, including through the use of one or more of: adhesives or cements, fusing techniques, mechanical connectors, or the like.

Additional potential structural features and specific examples of articles of footwear in accordance with examples of this invention will be described in more detail below.

3. Methods

Further aspects of this invention relate to methods of forming seams in textile components. Such methods may include: (a) providing a textile component including a first portion having a first exposed edge and a second portion having a second exposed edge, wherein the textile component may be composed of one or more separate pieces; (b) providing a first seam support member including a first thermoplastic material, wherein the first seam support member is shaped to include a third exposed edge that matches at least a portion of the first exposed edge; (c) providing a second seam support member including a second thermoplastic material, wherein the second thermoplastic material may be the same as or different from the first thermoplastic material, and wherein the second seam support member is shaped to include a fourth exposed edge that matches at least a portion of the second exposed edge; (d) placing the first seam support member on the first portion of the textile component such that the first exposed edge and the third exposed edge are in a layered relationship and such that the first thermoplastic material contacts the first portion of the textile component; (e) placing the second seam support member on the second portion of the textile component such that the second exposed edge and the fourth exposed edge are in a layered relationship and such that the second thermoplastic material contacts the second portion of the textile component; (f) exposing the first seam support member and the first portion of the textile component to conditions sufficient to engage the first seam support member with the first portion of the textile component via the first thermoplastic material to thereby provide a first exposed composite edge corresponding to a location of the layered first exposed edge and the third exposed edge; (g) exposing the layered second seam support member and the second portion of the textile component to conditions sufficient to engage the second seam support member with the second portion of the textile component via the second thermoplastic material to thereby provide a second exposed composite edge corresponding to a location of the layered second exposed edge and the fourth exposed edge; and (h) joining the first exposed composite edge to the second exposed composite edge in an abutting edge joint.

More specific aspects of this invention relate to methods of forming seams in upper members for articles of footwear. Such methods may include: (a) providing an upper construction including a first portion having a first exposed edge and a second portion having a second exposed edge, wherein the upper construction may be composed of one or more separate upper pieces; (b) providing a first seam support member including a first thermoplastic material, wherein the first seam support member is shaped to include a third exposed edge that matches at least a portion of the first exposed edge; (c) providing a second seam support member including a second thermoplastic material (the second thermoplastic material may be the same as or different from the first thermoplastic material), wherein the second seam support member is shaped to include a fourth exposed edge that matches at least a portion of the second exposed edge; (d) placing the first seam support member on the first portion of the upper construction such that the first exposed edge and the third exposed edge are in a layered relationship and such that the first thermoplastic material contacts the first portion of the upper construction; (e) placing the second seam support member on the second portion of the upper construction such that the second exposed edge and the fourth exposed edge are in a layered relationship and such that the second thermoplastic material contacts the second portion of the upper construction; (f) exposing the first seam support member and the first portion of the upper construction to conditions sufficient to engage the first seam support member with the first portion of the upper construction via the first thermoplastic material to thereby provide a first exposed composite edge corresponding to a location of the layered first exposed edge and the third exposed edge; (g) exposing the layered second seam support member and the second portion of the upper construction to conditions sufficient to engage the second seam support member with the second portion of the upper construction via the second thermoplastic material to thereby provide a second exposed composite edge corresponding to a location of the layered second exposed edge and the fourth exposed edge; and (h) joining the first exposed composite edge to the second exposed composite edge in an abutting edge joint.

The upper construction or other textile component may be provided in any desired manner without departing from this invention. For example, it may be obtained from a third party source. Alternatively, it may be manufactured, e.g., by cutting out one or more pieces from a blank or a piece of material (such as by die cutting, laser cutting, hand cutting, etc.).

Similarly, the first and second seam support members may be provided in any desired manners without departing from this invention. As one more specific example, they may be obtained from a third party source. Alternatively, they may be manufactured. As some more specific examples, the seam support members may be manufactured by: (a) applying a first thermoplastic film material to a first seam support material; (b) applying a second thermoplastic film material to a second seam support material (wherein the second thermoplastic film material may be the same as or different from the first thermoplastic film material and wherein the second seam support material may be the same as or different from the first seam support material); (c) cutting the first seam support material and the first thermoplastic film into a shape that includes a third exposed edge that matches at least a portion of the first exposed edge provided on the upper construction or other textile component; and (d) cutting the second seam support material and the second thermoplastic film into a shape that includes a fourth exposed edge that matches at least a portion of the second exposed edge provided on the upper construction or other textile component. The cutting steps may be performed in any desired manner, such as by die cutting, laser cutting, hand cutting, etc. Optionally, if desired, the seam support members may be cut from a single piece of material that includes the first and second thermoplastic materials and the first and second seam support materials.

The exposing steps also may comprise a variety of features without departing from this invention. For example, the exposing steps may take place simultaneously (optionally using the same apparatus at the same time or in separate apparatuses) or separately. The exposing steps may include: exposing the first seam support member and the first portion of the upper construction (or other textile component) and/or the second seam support member and the second portion of the upper construction (or other textile component) to at least one of increased heat or temperature conditions, increased pressure conditions, laser radiation, radio frequency energy, ultrasonic radiation, other radiation, etc.

The abutting edge joint may be made in any desired manner, including the various manners described above, without departing from this invention. In at least some example methods according to this invention, the "joining" step will include sewing the first exposed composite edge to the second exposed composite edge (e.g., via a zig-zag stitch) to thereby form a seam. If desired, the composite edges may be joined via a thread material (in the sewn stitch) made from a material that allows the thread material to be at least partially melted, absorbed, concealed, or masked in the seam. This may be accomplished, for example, by using a thermoplastic polyurethane thread to make the joint and then exposing the thread to at least one of increased heat or temperature conditions, increased pressure conditions, laser radiation, radio frequency waves, other radiation, etc., to thereby essentially melt the thread (or otherwise absorb or conceal the thread) within the remaining material in the joint. The exposing step(s) may take place either before or after the joining step takes place (optionally, at the same time that the thread is melted or otherwise treated, if such thread treatment steps are included in the method).

Aspects of this invention further relate to seams, textile components (including such seams), upper members (including such seams), articles of manufacture (including such seams), and/or articles of footwear (including such seams) made using any of the various methods (and variations thereon) described above and described in more detail below.

B. Specific Examples of Structures and Methods According to the Invention

Features and aspects of this invention now will be described in more detail with specific reference to FIGS. 1 through 10C. The reader is advised, however, that this detailed description and the accompanying drawings are provided merely to illustrate examples and features of the invention. The specific description and drawings should not be construed as limiting the invention.

1. The Upper Material

Aspects of this invention may be practiced using any desired type of upper material, including conventional upper materials that are known and used in the art. Such materials may include, for example: leather, synthetic leather, suede, polyesters, other polymeric materials, woven materials, non-woven materials, knitted materials, fabrics, textiles, etc., including combinations of such materials. When upper members are made from multiple different pieces or parts, each piece or part need not be made from the same material (i.e., a single upper construction may include multiple different types of materials).

In some example structures according to this invention, however, very lightweight, thin, and/or breathable (e.g., air permeable) fabrics or textiles may be used for upper members. One specific example of a suitable lightweight and/or breathable material that may be used in accordance with examples of this invention is a "spacer mesh" material 100, as illustrated in FIG. 1. A spacer mesh material 100 in accordance with at least some examples of this invention includes a fabric produced by sandwiching two fabric pieces 102 and 104 together (optionally dissimilar fabrics) while keeping some space between them. The two fabric pieces 102 and 104 may be selected to provide desired properties for the upper member, such as a soft, comfortable feel for the inner fabric piece 104 (which will form the shoe interior) and toughness, abrasion resistance, durability, stain resistance, etc., for the exterior fabric piece 102.

The space between the fabric pieces 102 and 104 may be maintained by providing a mesh material layer 106 between the two fabric pieces 102 and 104. The mesh material layer 106 may include several closely spaced holes, e.g., woven into a knit fabric making up the mesh layer 106. The various fabric layers may be joined together in any desired manner without departing from this invention, including through the use of adhesives. Alternatively, if desired, two or more of the various layers 102, 104, and 106 may be integrally formed together during a knitting or weaving process that results in production of the fabric material 100. This resulting fabric material 100 is porous, breathable, comfortable, and cool. These three-dimensional spacer mesh fabrics 100 may vary in thickness, but they are generally from 1 to 15 mm thick.

Various spacer mesh fabrics are known and are commercially available, such as fabrics used in car seat covers available under the name COVERKING® (available from Shrin Corporation of Santa Ana, Calif.). Other commercial sources of spacer mesh fabric, or other desired fabric or other materials for the upper construction (e.g., single layered or multilayered materials) may be used without departing from this invention.

2. Formation of the Upper Pieces

Figure 2:
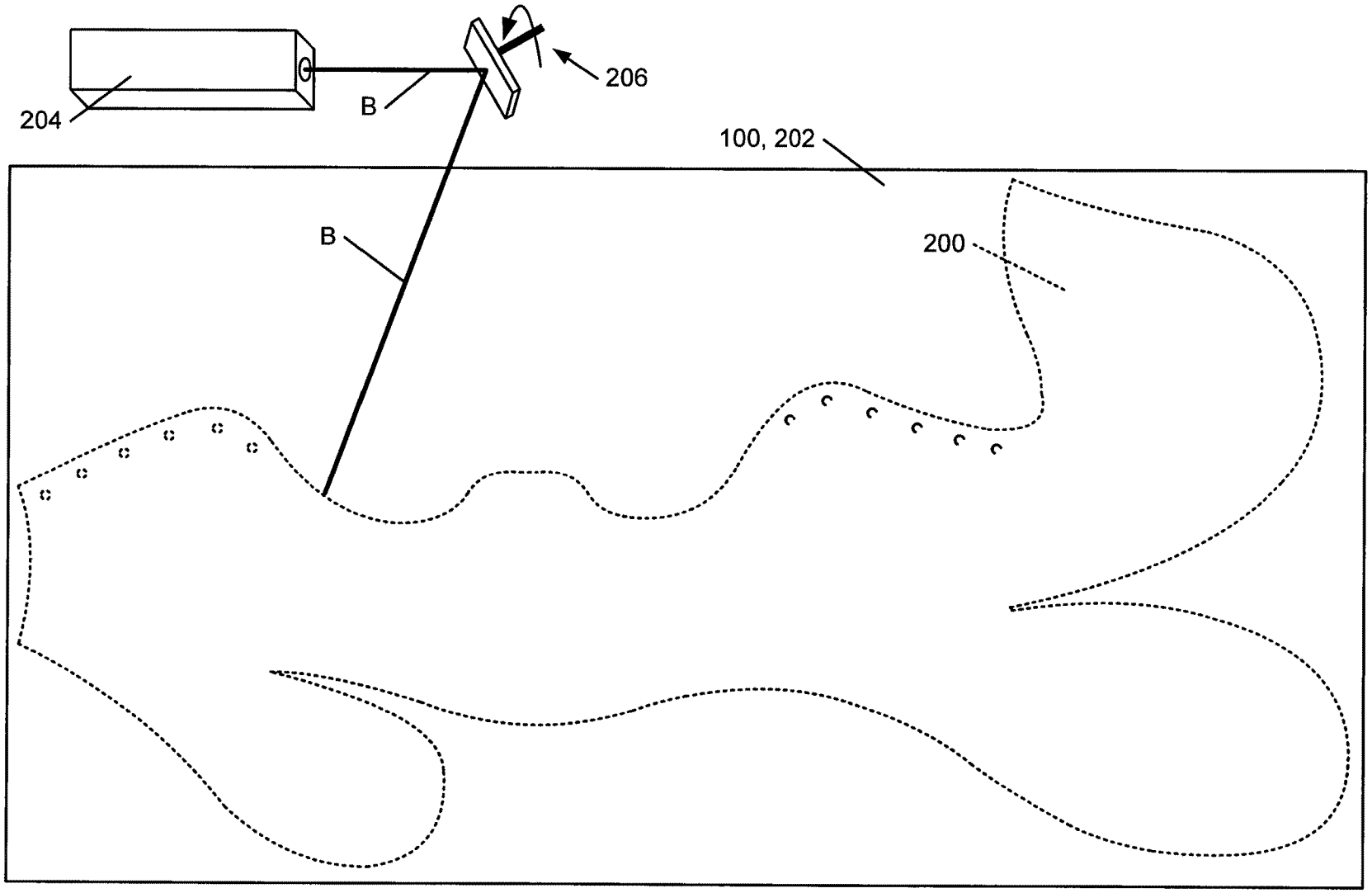
FIG. 2 illustrates an example of cutting an upper material from an upper material blank in accordance with at least some examples of this invention.

An upper construction may be formed using the upper material, such as the spacer mesh fabric 100 described above. As illustrated in FIG. 2, an upper member 200 may be cut from a fabric blank 202 formed from the desired upper material, such as spacer mesh material 100 described above. Any desired cutting operation may be performed without departing from this invention. In this illustrated example, the upper member 200 is cut from a fabric blank 202 using laser cutting techniques. This is represented in FIG. 2 by a laser source 204 that produces a beam B. The beam B may be scanned across the fabric blank 202 at appropriate locations (shown by dashed lines in FIG. 2) to thereby cut out the desired upper member 200 shape from the blank 202. The scanning system in FIG. 2 is generally represented by scanning mirror 206 (although any desired type of scanning system may be used without departing from this invention). Laser cutting systems and scanning systems for laser cutting of fabrics and other materials are conventionally known and used. Those skilled in the art can determine the various laser cutting parameters for specific materials (such as scanning speed, laser power, beam diameter, etc.) through the use of routine experimentation. As other alternatives, however, the fabric blank 202 may be cut into the desired shape by any other desired cutting methods or techniques, such as by die-cutting, rotary cutting, hand cutting, etc.

While illustrated as a single piece construction, uppers may have any desired constructions, number of pieces, shapes, sizes, and the like without departing from this invention. Additionally, a single blank 202 may have multiple upper members 200 or upper member pieces cut therefrom without departing from this invention.

Figure 3:
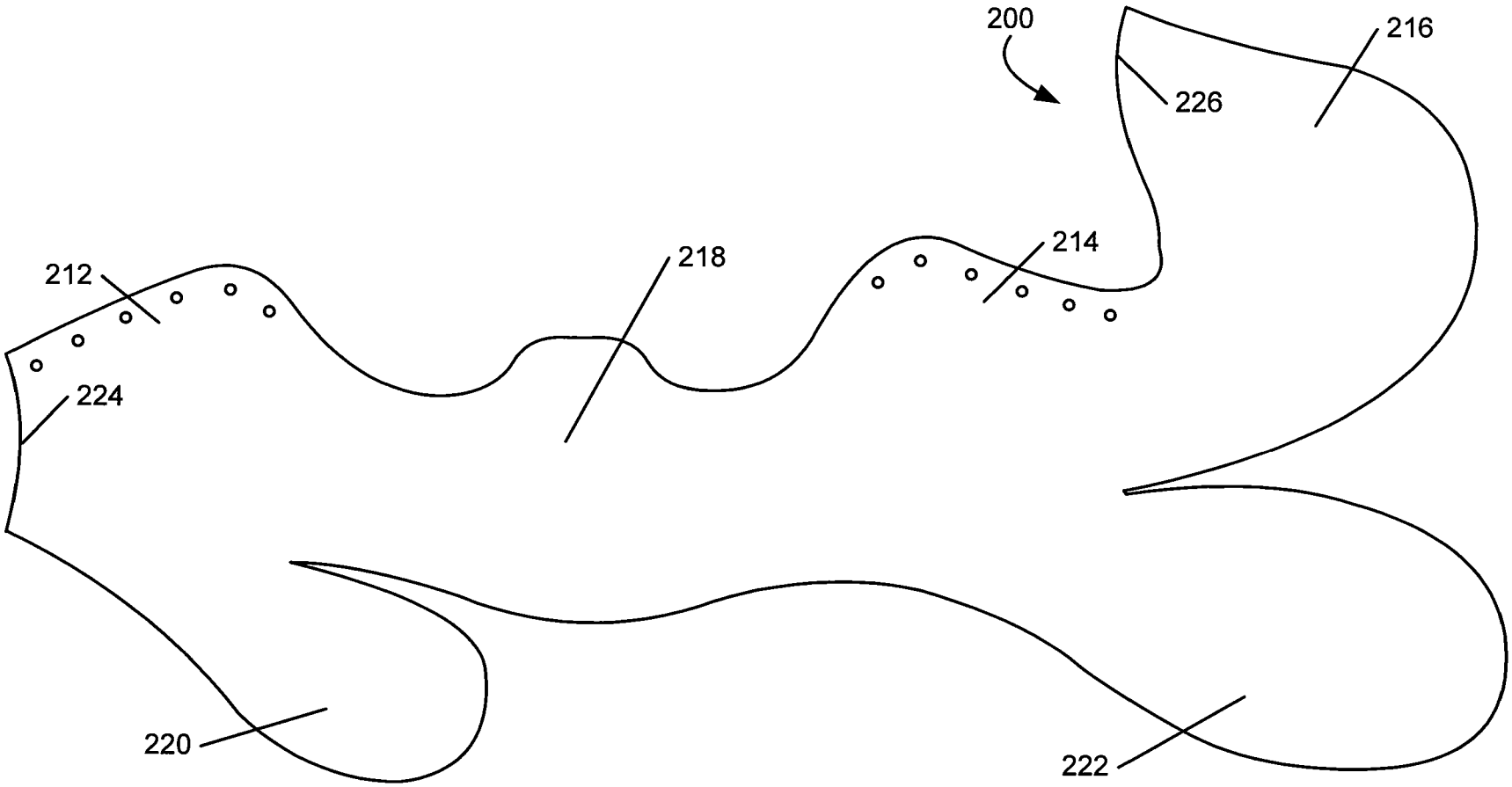
FIG. 3 illustrates an example cut out upper material in accordance with this invention.

FIG. 3 illustrates one example of an upper member 200 that may be produced in accordance with this invention. In this example structure, the upper member 200 constitutes a single piece that includes: a medial side and lace eyelet section 212, a lateral side and lace eyelet section 214, a toe portion 216, a rear heel portion 218, and footbed portions 220 and 222. Although not shown in FIG. 2 or 3, the upper construction may additionally include a tongue member, e.g., integrally formed as part of the one piece upper member 200 (e.g., extending from one of the eyelet sections 212 or 214 or from the toe portion 216), or separately formed (from the same upper material blank 202 or from a different blank or even a different upper material). The upper member 200 may be shaped and stitched in the necessary places (optionally along with a tongue part, as mentioned above) to provide a final upper construction. As one example in the illustrated upper member 200, edge 224 may be engaged with edge 226 when forming the upper construction. Various examples of seam formation features of the invention will be described in more detail below.

3. The Seam Support Member

As mentioned above, the upper material, in at least some example structures according to this invention, may be selected so as to be very lightweight, thin, breathable (e.g., air permeable), soft, and/or comfortable. Such materials, however, do not always have great strength, durability, or structural integrity. For example, such materials may not have adequate strength or structural integrity to support the seams that may be necessary to form an upper construction and/or to maintain the upper construction in the desired shape. As one more specific example, when sewn, the threads of the seam may tend to tear or pull through the fabric thus splitting the seam. Additionally or alternatively, the material may be layered before being sewn (in an effort to provide adequate thickness and strength to support a seam), which can cause a bulky and uneven seam and discomfort to the wearer (such a construction also utilizes more upper material). As another example, such thin and soft materials may be inadequate to hold the upper's shape when it is not being worn (such that the upper appears "deflated"), which can cause difficulties in putting on the article of footwear.

Therefore, in accordance with at least some examples of this invention, the upper members may be modified to include seam support members (and optionally other support members) at various locations in the footwear structure. When utilized as a seam support member, the material may be a material that is capable of maintaining a stable edge and capable of supporting a sewn seam (e.g., without readily pulling the seam apart under normal usage forces). While a variety of materials may be used as seam support materials without departing from this invention, in some example structures according to the invention the seam support material may be leather, synthetic leather, suede, synthetic suede materials, polyesters, other polymer based fabrics and materials, thick fabric materials, and the like. One suitable material is an ultra-microfiber, suede-like, non-woven fabric material known as Ecsaine®, which is commercially available from Toray Industries, Inc.

Figure 4:
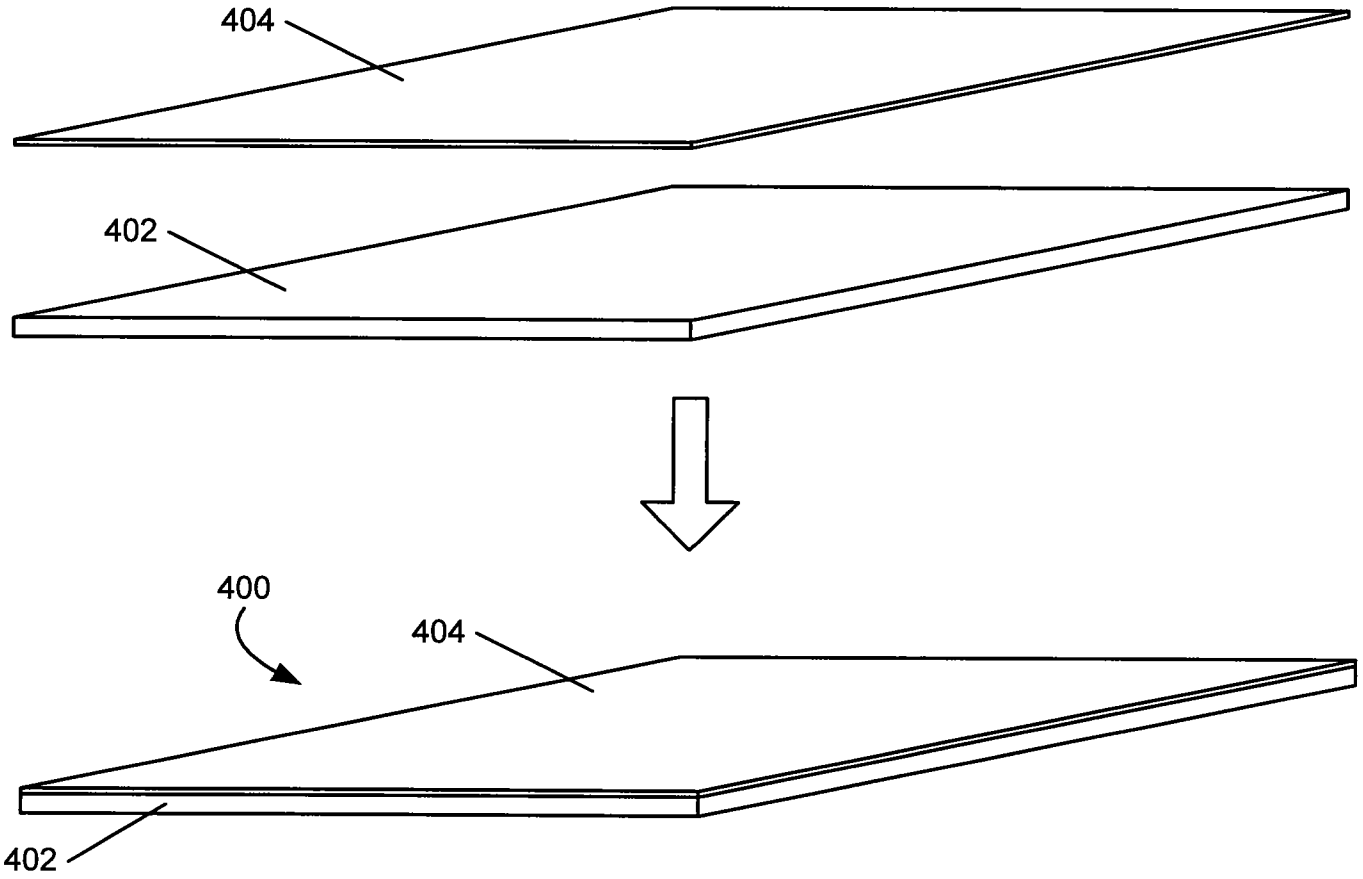
FIG. 4 illustrates construction of an example seam support member material that may be used in at least some examples of this invention.

As illustrated in conjunction with FIG. 4, a seam support member blank 400 in accordance with at least some examples of this invention may comprise a two layer construction. One layer of this blank 400 constitutes a seam support material 402, e.g., of the types described above, such as an Ecsaine® ultra-microfiber, suede-like, non-woven fabric material available from Toray Industries, Inc. The second layer 404 is an adhesive film material (such as a thermoplastic polyurethane material) that will enable engagement of the seam support material 402 to the upper member 200. While any desired adhesive film material 404 may be used without departing from this invention, in accordance with at least some examples of this invention, the adhesive film material 404 will be a Bemis material available from Bemis Associates, Inc., such as Bemis's Sewfree® material.

Production of the seam support member blank 400 (e.g., the combination of the seam support material 402 and the adhesive film material 404) will be described in more detail in conjunction with FIGS. 4 and 5. First, the overall seam support member blank 400 is prepared. This may be accomplished by applying an adhesive film material layer 404 to a seam support material layer 402 to make a composite sheet of the seam support member blank 400. Optionally, in accordance with at least some examples of this invention, the adhesive features of the adhesive film material layer 404 may be used to hold these layers 402 and 404 together without further treatment. In other examples, however, some type of additional treatment (such as ultrasonic, radio frequency, laser, or other radiation treatments, heat treatment, pressure treatment, etc.) may be used to help bind these materials 402 and 404 together. If desired, release paper may be provided on one or both sides of the adhesive film material 404 to prevent it from sticking to objects before it is desired.

Figure 5:
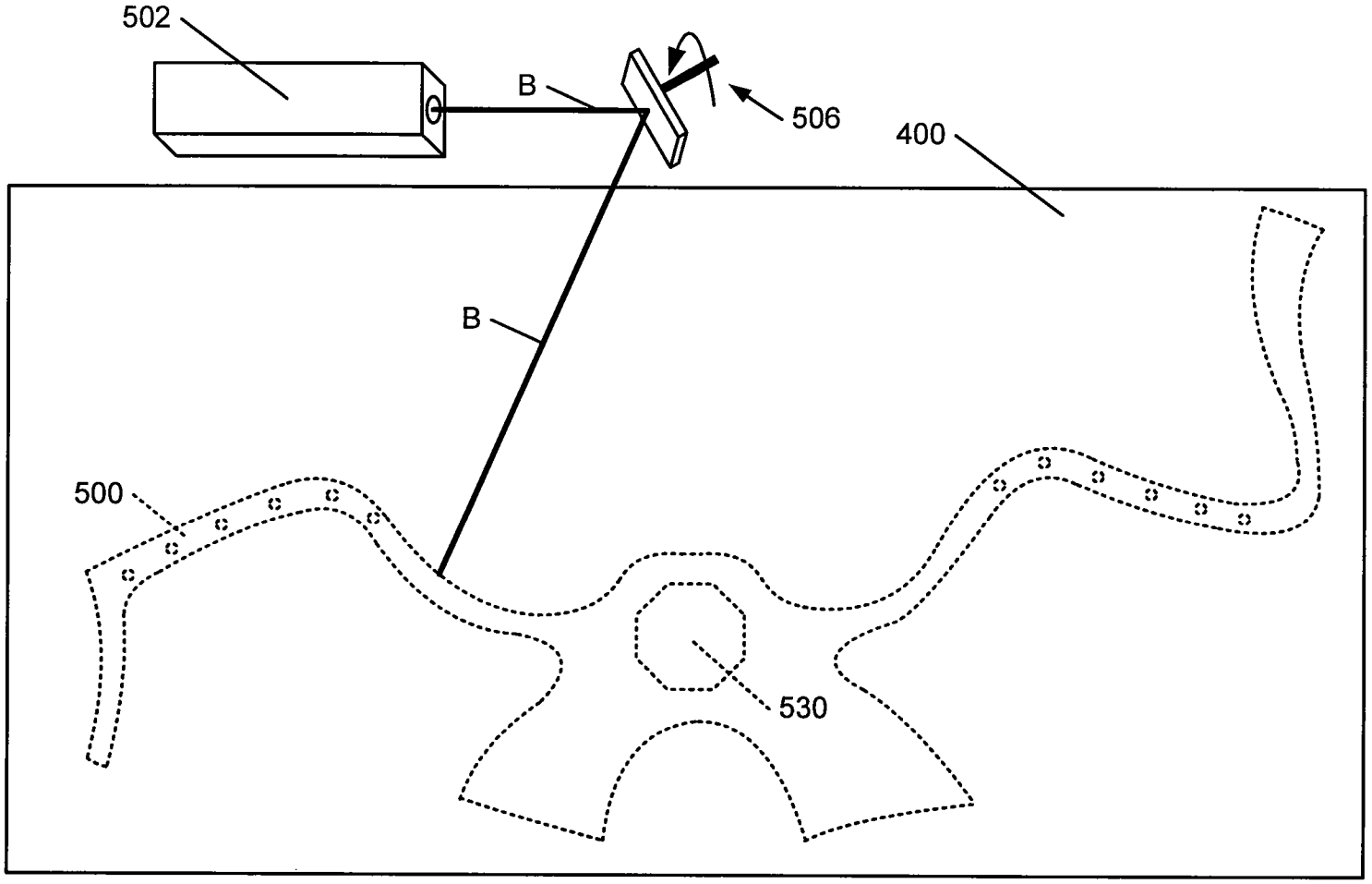
FIG. 5 illustrates an example of cutting a seam support member from a seam support material blank in accordance with at least some examples of this invention.

Once the seam support member blank 400 is prepared, it then may be cut into the desired shape for the seam support member 500, as shown in FIG. 5. Any desired cutting operation may be performed without departing from this invention. In this illustrated example, the final seam support member 500 is cut from a seam support member blank 400 using laser cutting techniques. This is represented in FIG. 5 by a laser source 502 that produces a beam B. The beam B may be scanned across the seam support member blank 400 at appropriate locations (shown by dashed lines in FIG. 5) to thereby cut out the desired seam support member 500 shape from the blank 400. The scanning system in FIG. 5 (which may be the same as or different from the scanning system shown in FIG. 2) is generally represented by scanning mirror 506. As noted above, laser cutting systems and scanning systems for laser cutting of fabrics and other materials are conventionally known and used, and those skilled in the art can determine the various laser cutting parameters for specific materials (such as scanning speed, laser power, beam diameter, etc.) through the use of routine experimentation. As other alternatives, however, the blank 400 may be cut into the desired shape by any other desired methods or techniques, such as by die-cutting, rotary cutting, hand cutting, etc.

While the example process described above includes cutting the adhesive film material 404 and the seam support material 402 simultaneously in a single cutting operation, these materials also may be cut separately, if desired, and then engaged with one another without departing from this invention. Also, if desired, this cutting step may be combined and performed simultaneous with the cutting of the upper member described above.

Figure 6:
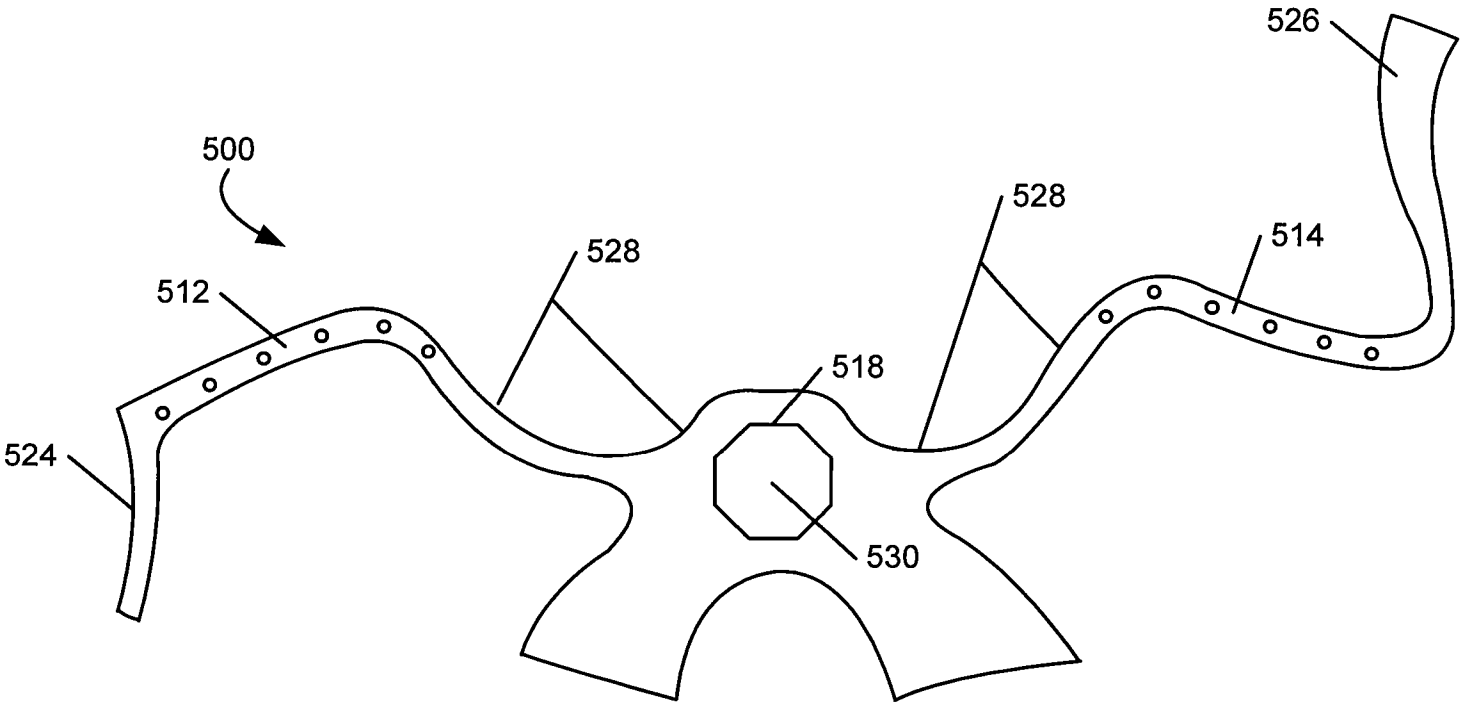
FIG. 6 illustrates an example seam support member in accordance with this invention.

FIG. 6 illustrates the final cut out seam support member 500 prepared through this example process. In this example structure 500, the seam support member 500 constitutes a single piece that includes: a medial side lace eyelet section 512, a lateral side lace eyelet section 514, and a rear heel portion 518. Furthermore, this seam support member 500 includes an edge 524 (which corresponds to edge 224 of upper member 200) that will be engaged with edge 526 (which corresponds to edge 226 of upper member 200) when forming the upper construction.

While not necessarily supporting an eventual seam in the overall upper member construction, the seam support member 500 may include additional portions that support various edges of the overall upper construction. For example, edge 528 of the seam support member 500 may be provided along the foot-receiving opening of the article of footwear to provide a stable edge and to prevent fraying of the upper member material along that edge. Additionally, seam support material may be provided at other desired locations in the upper structure, e.g., to provide support, to provide decoration, etc.

FIGS. 5 and 6 show another feature that may be used in structures and methods according to this invention. As shown, the seam support member 500 may include various design features cut into it (such as the cut out octagon member 530). In this manner, if the seam support member 500 is provided in a color that differs from the underlying upper material color, the upper material will show through portions of the seam support member 500 (such as through the cut out octagon member 530), to provide an interesting aesthetic design and appearance. Any desired design element 530 may be cut into the seam support member structure 500, such as shapes, logos, alpha-numeric characters, etc.

4. Forming the Composite Upper Member

Figure 7A:
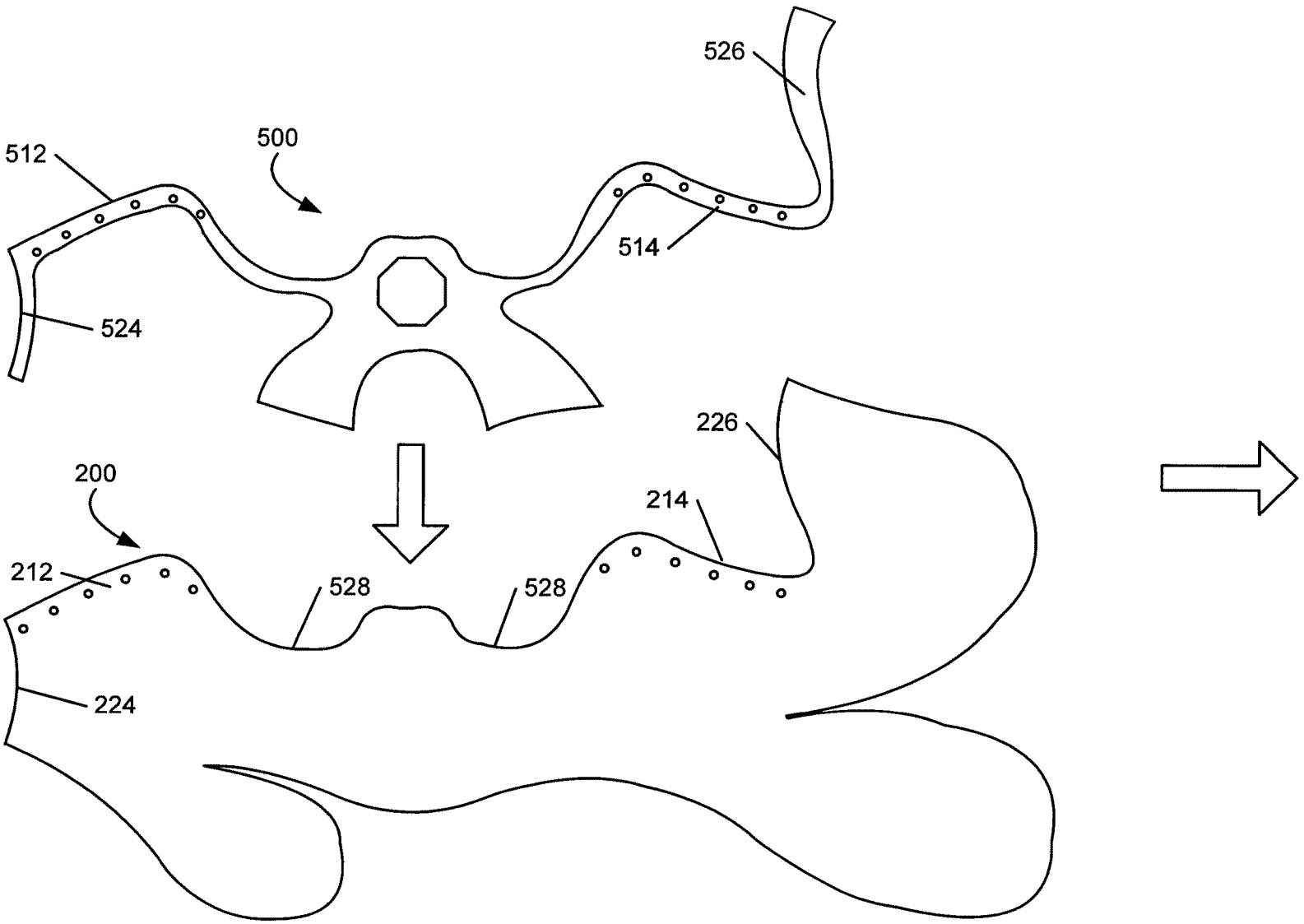
FIGS. 7A and 7B illustrate construction of an example upper member, including composite edge areas to be joined by an abutting edge joint, in accordance with this invention.
Figure 7B:
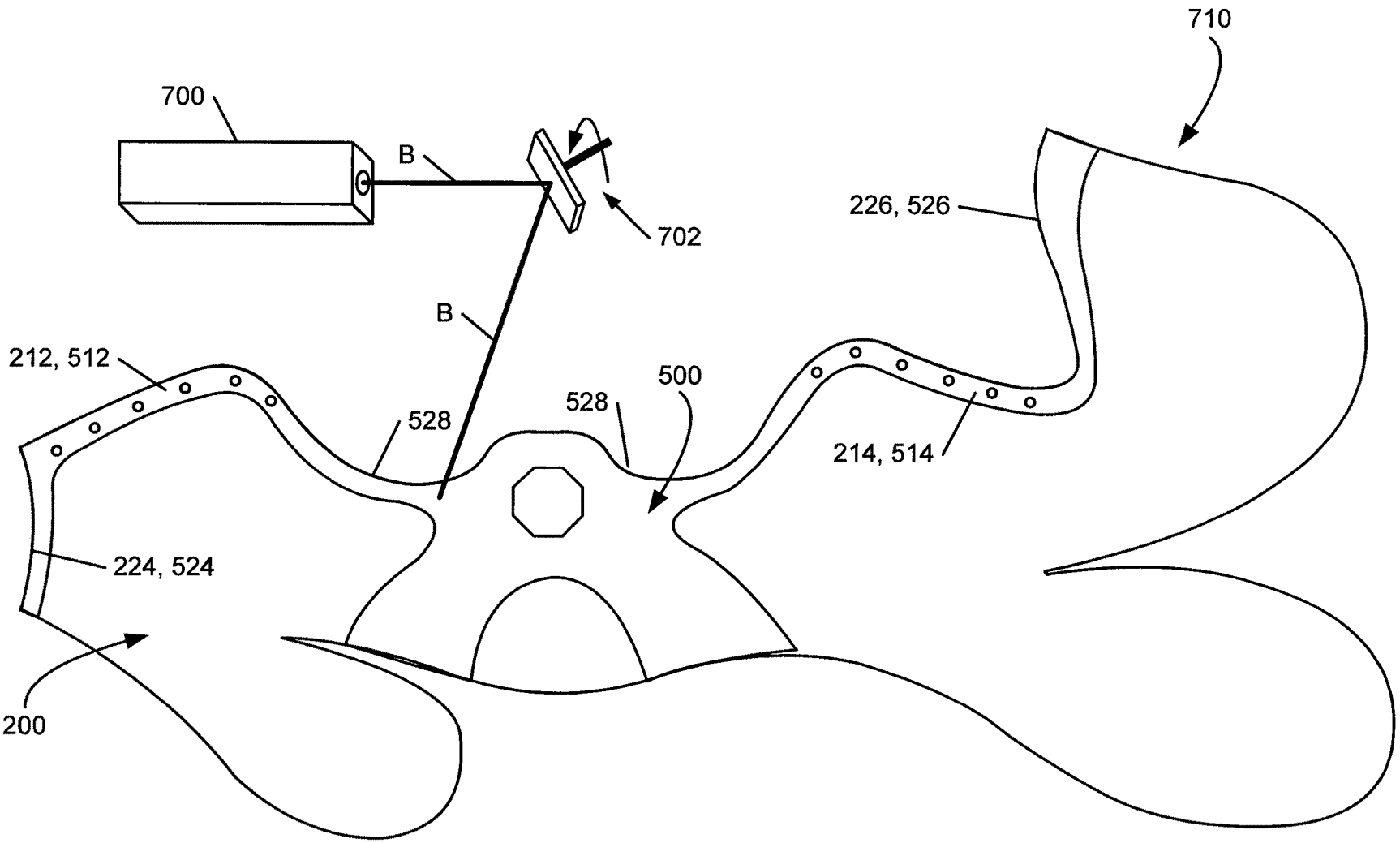

FIGS. 7A and 7B illustrate formation of a composite upper member including the upper material and a seam support member in accordance with at least some examples of this invention. As shown in these figures, in this example process, the cut out seam support member 500 is aligned with and overlaid onto the cut out upper member 200 with the thermoplastic film material 404 side of the seam support member 500 (after any optional release paper has been removed) in direct contact with the surface of the upper member 200. These materials may stick together due to the adhesive nature of the thermoplastic film material 404. These members 200 and 500 may be joined together such that the edges of the desired seam support member 500 match up with the desired edges of the upper member 200. Specifically, as illustrated in these figures, the seam support member 500 and the upper member 200 may be aligned such that the seam edge 524 of the seam support member 500 overlays and aligns with the seam edge 224 of the upper member 200 and such that the seam edge 526 of the seam support member 500 overlays and aligns with the seam edge 226 of the upper member 200. Likewise, as illustrated in these figures, the eyelet areas 212 and 214 of the upper member 200 are arranged to align with the eyelet areas 512 and 514 of the seam support member 500. Other desired edges also may be aligned and overlaid.

Once properly aligned, in accordance with at least some examples of this invention, the upper member 200 and seam support member 500 may be more permanently engaged with one another. This may be accomplished by "welding" the upper member 200 to the seam support member 500 using the thermoplastic film material 404 of the seam support material 500. This "welding" or activation step may be accomplished, in accordance with at least some examples of this invention, by laser "welding," i.e., by exposing the layered upper member 200 and seam support member 500 to laser radiation (as generally illustrated in FIG. 7B) using a laser source 700 which scans over the surface of the combined upper member 200 and seam support member 500 using a scanning mechanism 702. The laser and scanning systems used in the procedure of FIG. 7B may be the same as or different from the systems shown in FIGS. 2 and 5. As noted above, laser treatment and scanning systems of this type are conventionally known and used, and those skilled in the art can determine the various laser treatment parameters for specific materials (such as scanning speed, laser power, beam diameter, etc.) through the use of routine experimentation.

Other systems and/or treatment techniques may be used to engage the upper member 200 and seam support member 500 with one another. For example, the members 200 and 500 may be engaged with one another simply using adhesives or cements, optionally with additional heating or pressure application treatments to activate the adhesives or cements. As additional examples, radio frequency energy, ultrasonic radiation, or other radiation treatments, may be used to engage the upper member 200 with the seam support member 500.

After engagement of the upper member 200 and seam support member 500, the resulting composite member 710 (including composite edges 224/524 and 226/526) may be ready for stitching and/or otherwise formation into an upper member for an article of footwear. Examples of stitching and/or seam forming procedures in accordance with this invention will be described in more detail below.

Any or all of the seams of the upper construction may be made to include a seam support member portion. Similarly, any or all edges of the upper construction (or any or all exposed edges of the upper construction) also may be made to include a seam support member portion (even if those edges will not include a seam, but rather, the seam support member is present simply for structural support and/or to prevent fraying). If desired, the seam support material at an edge (such as edge 528) may be sized sufficiently so that it may be folded over to completely cover the exposed edge of the upper member 200. Also, while the present example shows a single seam support member 500 for a single upper, any number of upper member pieces and/or seam support member pieces may be provided in a single overall upper construction without departing from this invention.

5. Forming Seams

As noted above, aspects of this invention relate to providing one or more of the seams in the upper member for an article of footwear in the form of an abutting edge joint seam. FIGS. 8A through 8D illustrate an example of making such a seam.

Figure 8A:
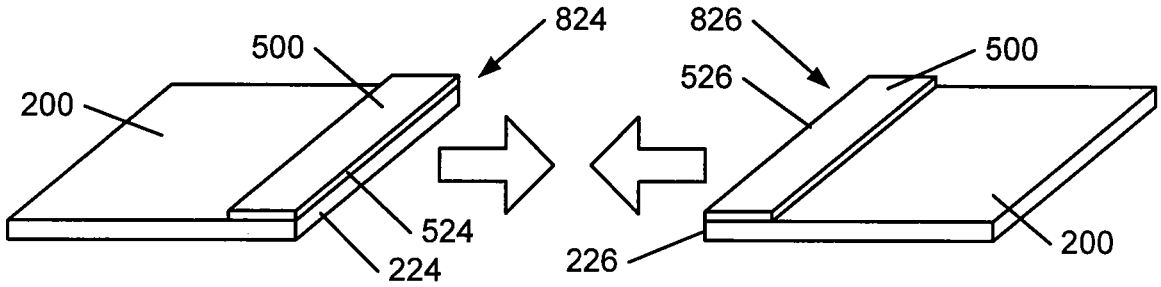
FIGS. 8A through 8E illustrate example steps involved in producing an abutting edge joint in accordance with this invention.

As illustrated in FIG. 8A, the production of the abutting edge joint (e.g., a butt seam) in accordance with at least some examples of this invention includes starting with two edges 824 and 826 of upper material that are to be engaged (e.g., the edges 824 and 826 may be located on a single piece of upper material or two (or more) separate pieces of upper material). The edges 824 and 826 may be straight or curved or shaped in any desired manner, and the edges 824 and 826 may generally mate together with one another. The edge 824 in this illustrated example may comprise the composite edge of the upper member 500 from FIGS. 7A and 7B, including the exposed edges 224 and 524 of the upper member 200 and the seam support member 500, respectively (the term "exposed" as used herein in this context refers to the open or unshielded character of an edge, not the fact that the edge may have been exposed to radiation, heat, or other conditions, e.g., during one or more of the steps described above, and not to whether or not the edge will be exposed in the final footwear construction). Likewise, the edge 826 in this illustrated example may comprise the composite edge of the upper member 500 from FIGS. 7A and 7B, including the exposed edges 226 and 526 of the upper member 200 and the seam support member 500, respectively.

Figure 8B:
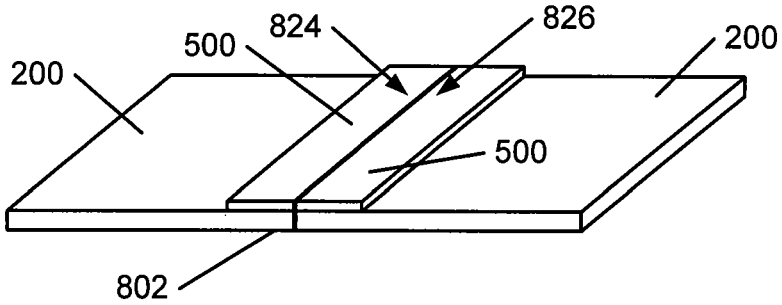

The two mating edges 824 and 826 are brought together such that the edges match up with one another, as illustrated in FIG. 8B, along an abutting edge. This type of arrangement is advantageous because, as illustrated in FIG. 8B, this arrangement provides a smooth lower surface 802, and this smooth lower surface 802 will correspond to the interior surface of the upper that contacts the wearer's foot.

Figure 8C:
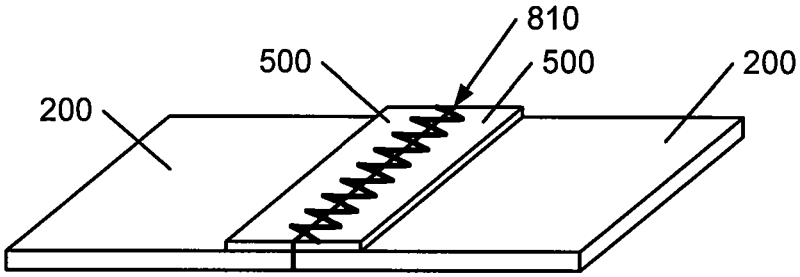

Once correctly positioned, the two mating edges 824 and 826 then are joined to one another. While any desired joining process may be used without departing from this invention, in this illustrated example the two mating edges 824 and 826 are joined together using a sewn seam 810, as illustrated in FIG. 8C. While any desired type of sewing process and/or stitch may be used without departing from this invention, including conventional sewing processes and conventional stitches as are known and used in the art, in this illustrated example, the edges 824 and 826 are joined together in a sewn seam 810 using a zig-zag stitch. The sewing step may take place using a sewing machine, including conventional sewing equipment as is known and used in the art.

Figure 8D:
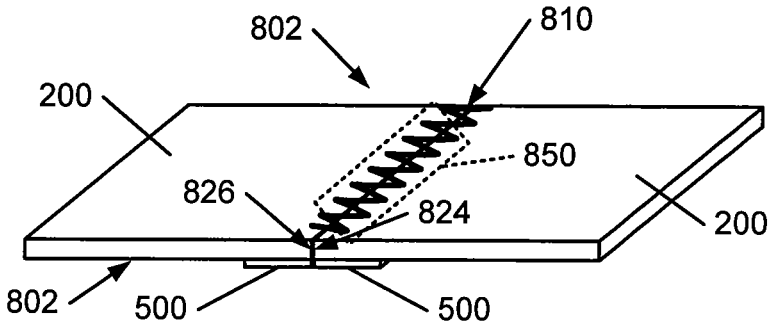

FIG. 8D illustrates the underside or lower surface 802 of the abutting edge joint formed in the procedure described in FIGS. 8A through 8C. As shown, the lower surface 802 remains substantially smooth, with no (or essentially no) overlap of the two edges 824 and 826 making up the seam 810. This lack of overlapping upper and seam support materials at the seam 810 enhances the comfort of the upper where it contacts the wearer's foot, because overlapping seams tend to exert more pressure on contact areas with the foot (than a non-overlapping seam), which can cause discomfort, irritation, blisters, etc. In addition, the lack of overlapping upper materials at the seam 810 reduces the amount of material in the overall upper construction, which reduces costs, waste, weight, etc. Optionally, if desired, a thin layer of thermoplastic or other film material 850 may be placed over at least some portions of the interior surface of the seam 810 (e.g., an adhesive film on the interior surface 802 of the upper construction) to further flatten and/or mask the feel of the sewn seam on the user's foot.

Figure 8E:
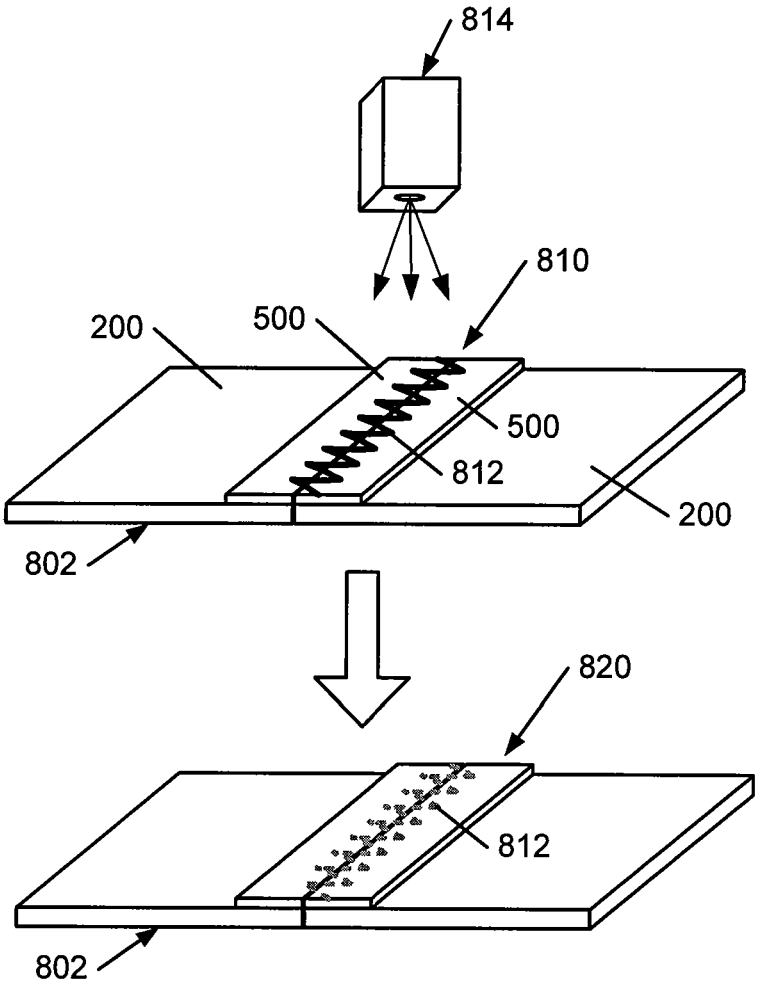

FIG. 8E illustrates another potential feature that may be included in upper constructions and/or methods in accordance with examples of this invention. If desired, the thread material 812 of the sewn seam 810 (e.g., the thread material 812 of the zig-zag stitch) may be made from a material that allows for further treatment of the stitch and the seam 810. For example, the thread material 812 may be made from a thermoplastic material (e.g., similar to or the same as the thermoplastic film material 404 of FIG. 4). This thread material 812 may be further treated, e.g., by application of heat or pressure; by exposure to laser radiation, ultrasonic radiation, or other radiation; etc., such that the thread material 812 melts or otherwise becomes at least partially absorbed, concealed, or masked in the final seam 820. This treatment step is generally represented in FIG. 8E by the exposure or treatment system 814, and the at least partial absorption, masking, or concealment is represented in FIG. 8E by graying out the thread material 812 and showing it in broken lines. As noted above, if desired, a thin layer of thermoplastic or other film material may be placed over at least some portions of the interior surface of the seam 810 (e.g., an adhesive film on the interior surface 802 of the upper construction), which can provide a base material on the underside 802 of the upper construction into which the thread material 812 may be melted or otherwise at least partially absorbed, concealed, or masked. All or only some portions of the thread materials 812 may be further treated in this manner.

6. Alternative Upper Constructions

Figure 9:
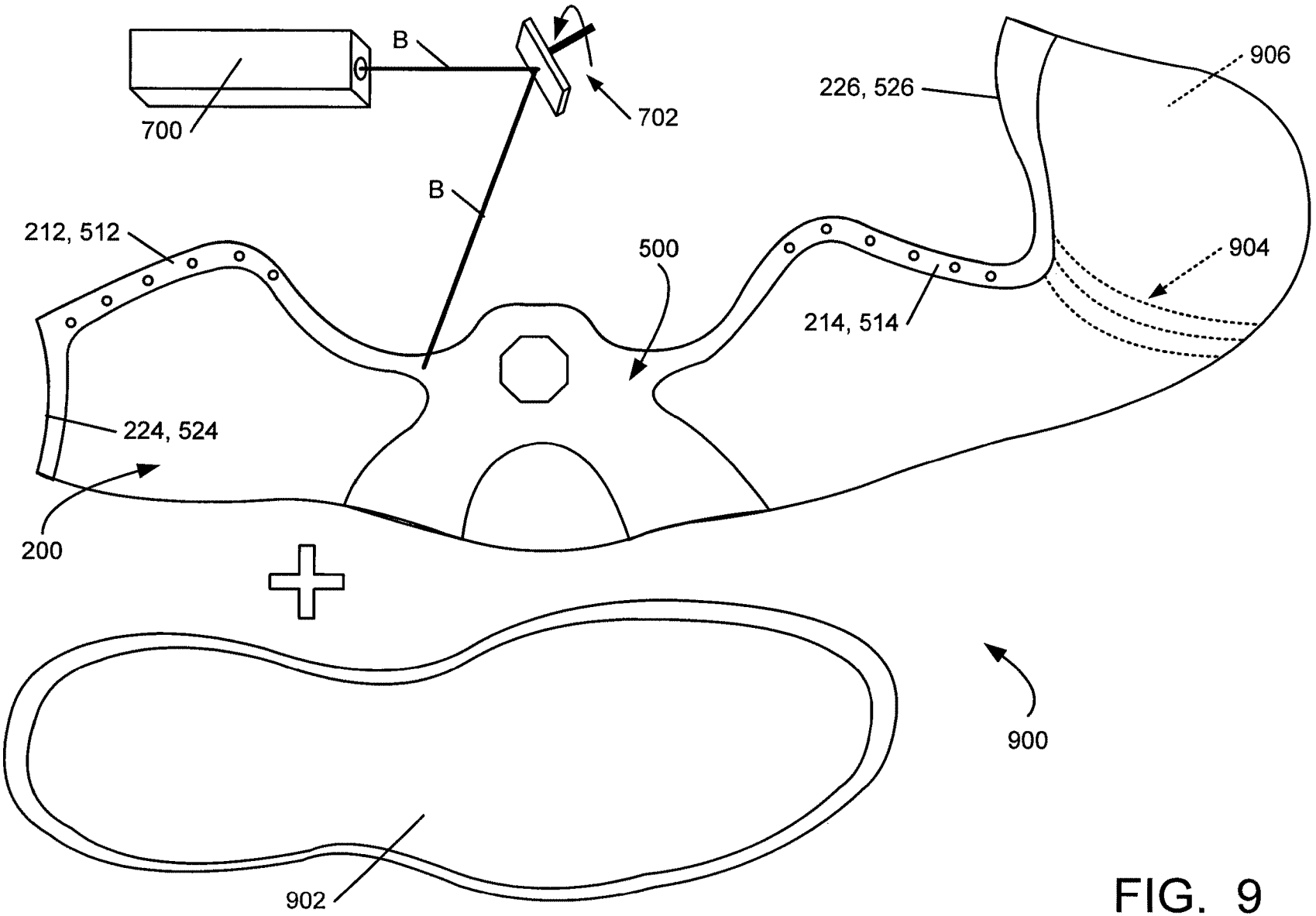
FIG. 9 illustrates various alternative features of an upper member construction that may be used in at least some example structures according to this invention.

FIGS. 1 through 8E illustrate various examples of an upper construction in which the upper is made from a single piece and it includes footbed portions 220 and 222 integrally formed as part of the upper material 200. Many variations in the upper construction are possible without departing from this invention. For example, as illustrated in FIG. 9, an upper member 900 may be formed with a similar construction in a similar manner as described above (where relevant, the same reference numbers are used in FIG. 9 as used, for example, in FIGS. 1-8E, and particularly in FIGS. 7A and 7B, to represent the same parts and procedures as described above in conjunction with FIGS. 1-8E), but instead of including the footbed portions 220 and 222 as part of the upper material, the footbed is provided as a separate strobel member 902 that is engaged with the composite upper material 200 and seam support material 500. Any manner of engaging the strobel member 902 with the composite upper material 200 and seam support material 500 may be used without departing from this invention, including manners that are conventionally known and used in the art, such as sewing or stitching, fusing techniques, mechanical connectors, etc. Optionally, if desired, all or some portion of the strobel member 902 may be joined to the composite upper material 200 and seam support material 500 using an abutting edge joint, e.g., as described above. The strobel member 902 may be considered as part of the overall upper construction 900, or it may be considered as a separate part from the upper construction.

The strobel member 902, when used, may be made of any desired materials and in any desired constructions without departing from this invention, including from conventional materials and in conventional constructions as are known and used in the art. Examples of such materials include one or more layers of fabric materials, foam materials (e.g., polyurethane foam, ethylvinylacetate foam, etc.), or combinations thereof. In some instances, the strobel member 902 can help provide shape to the overall upper construction.

Additionally, if desired (as illustrated by broken lines in FIG. 9), the upper member 200 may be made from multiple pieces. This is shown by the additional optional seam 904 shown in FIG. 9, which separates out a separate toe box cover member 906 that may be joined with the remainder of the upper member 200. Any desired manner of engaging the various parts of an upper member together may be used without departing from this invention, including conventional engagement techniques as are known and used in the art. Also, if desired, the various parts of the upper member may be engaged together using an abutting edge joint, e.g., in the manners described above in conjunction with FIGS.

8A through 8E. Any number of seams and/or any number of upper pieces may be joined together for an upper construction in accordance with at least some examples of this invention, and any number of seams in such constructions may be provided as abutting edge joints, e.g., of the types described above.

7. Footwear Constructions

Figure 10A:
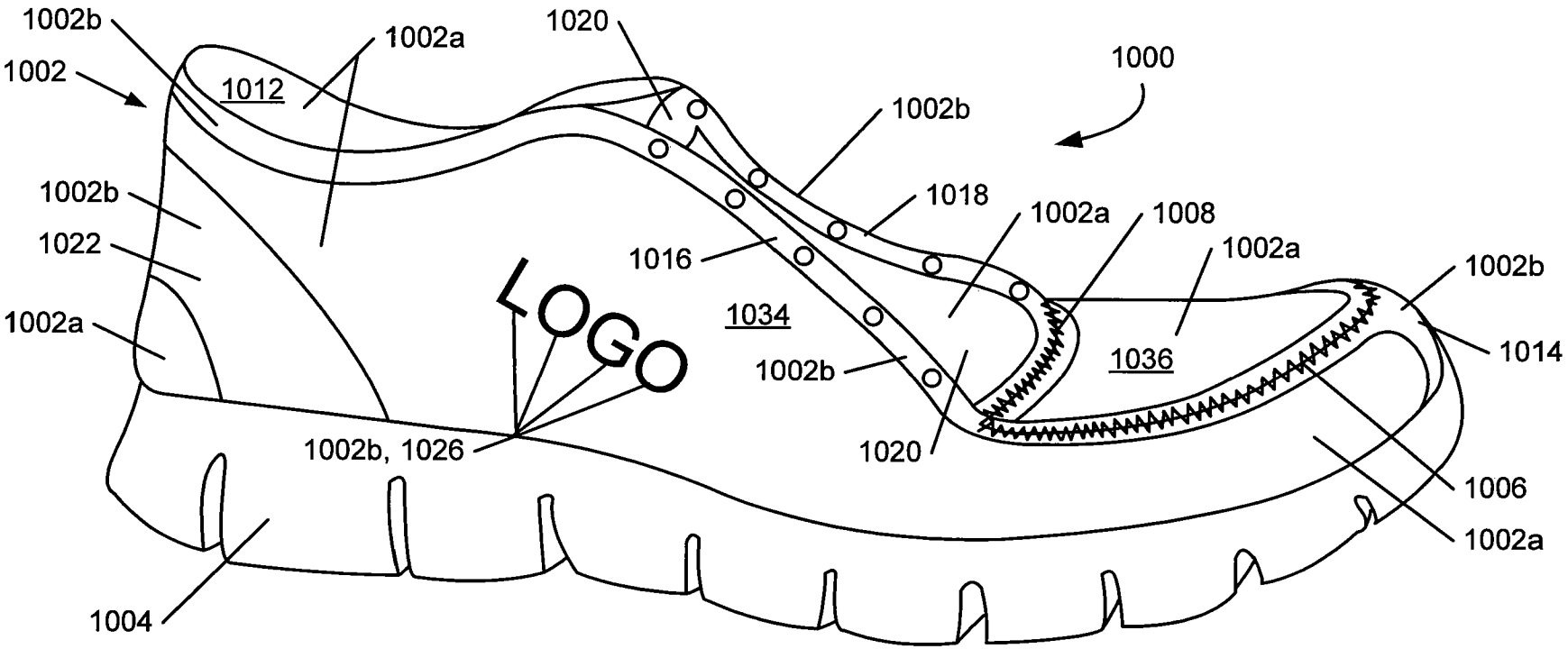
FIGS. 10A through 10C illustrate an example article of footwear, including various example features and structures in accordance with this invention.
Figure 10B:
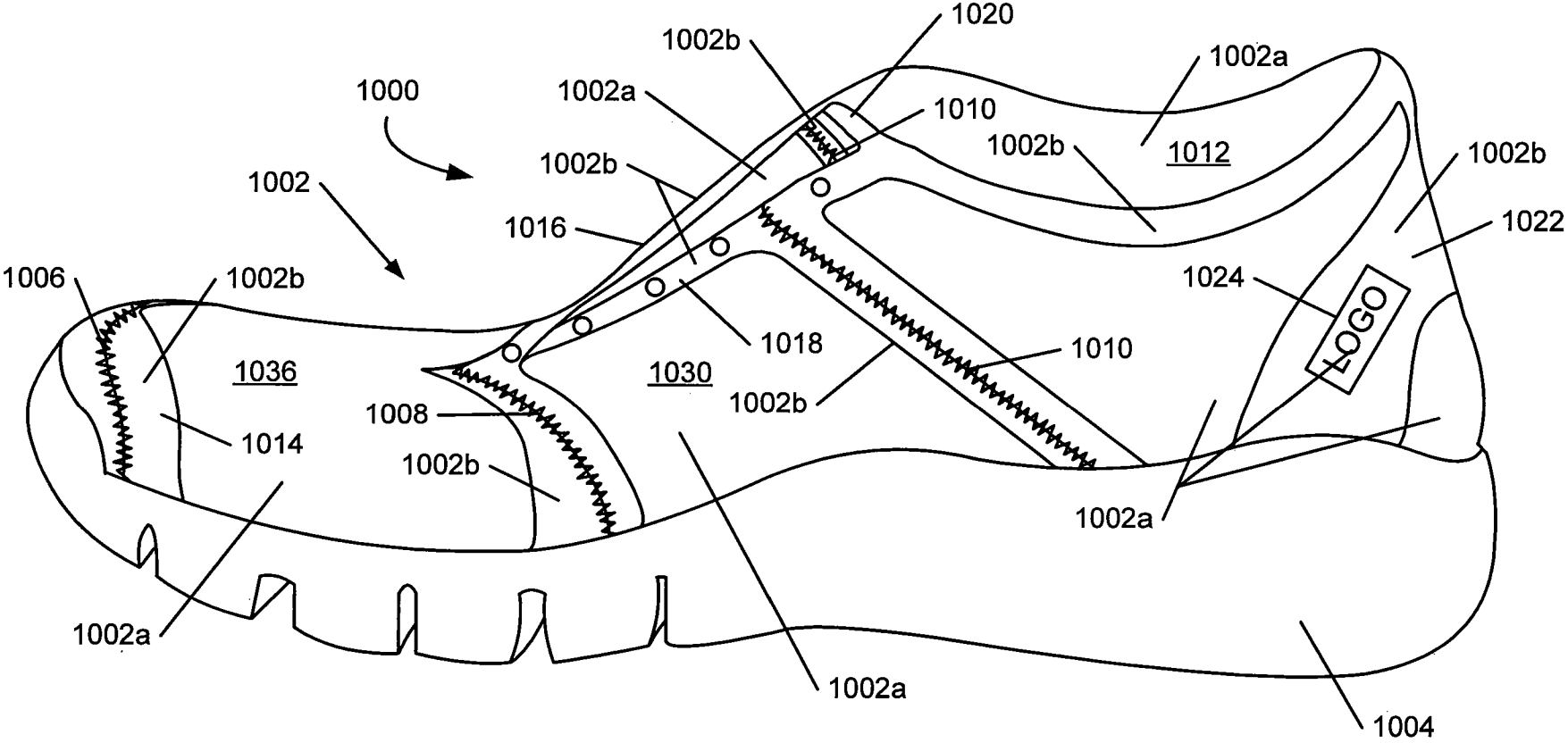
Figure 10C:
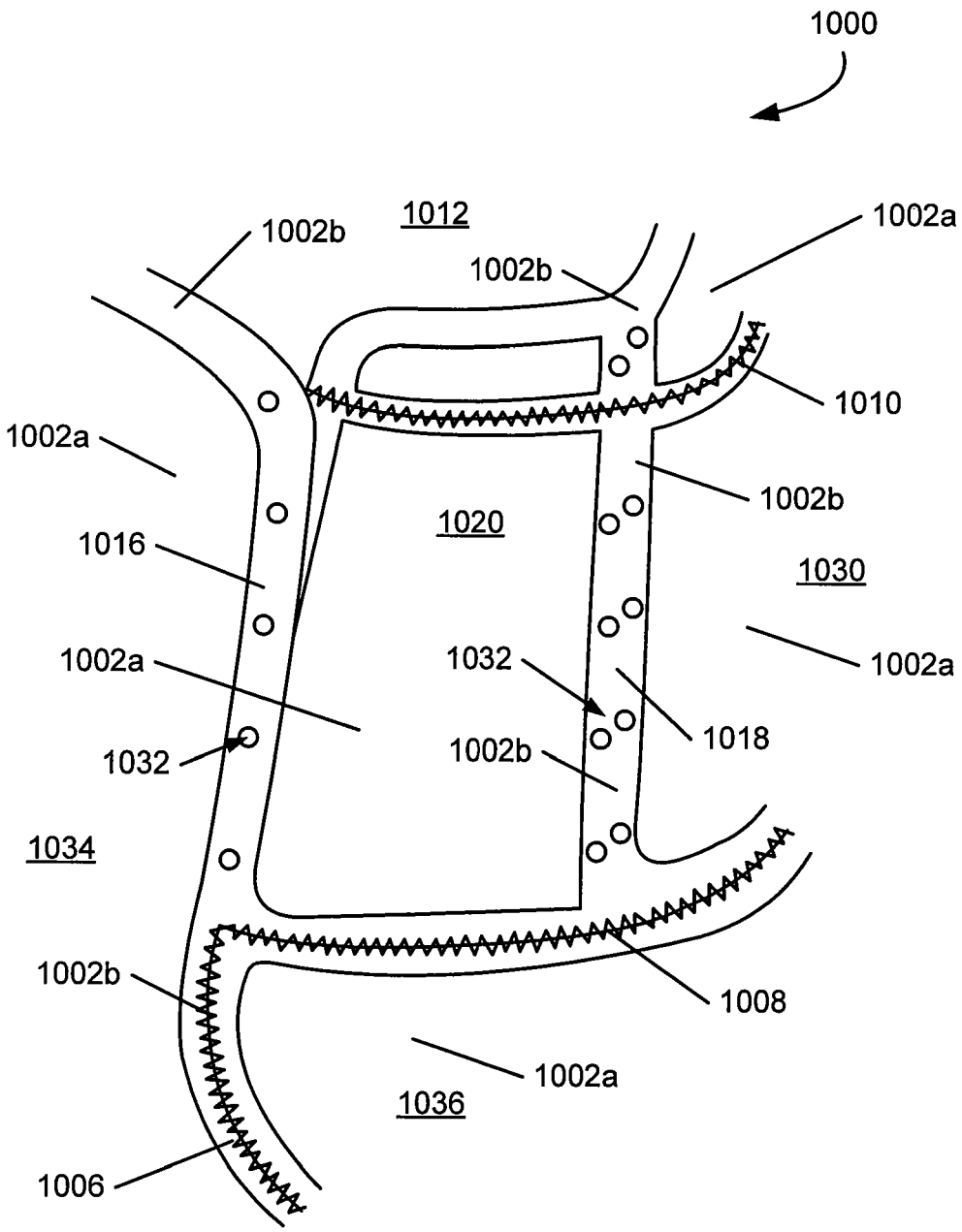

FIGS. 10A through 10C illustrate an example article of footwear 1000 and features thereof that may be produced in accordance with examples of this invention. FIG. 10A illustrates the lateral side of the article of footwear 1000, FIG. 10B illustrates the medial side, and FIG. 10C provides additional details relating to the instep and tongue area of this example structure 1000. As shown in FIGS. 10A and 10B, the article of footwear 1000 includes an upper member 1002, e.g., of the types described above, wherein at least one seam is produced using an abutting edge joint. The upper member 1002 may be engaged with a sole structure 1004. Any desired sole structure 1004 may be provided without departing from this invention, including any desired sole materials, combinations of materials, constructions, and the like, including conventional sole structures, materials, combinations of materials, and constructions, as are known and used in the art. As some more specific examples, the sole structure 1004 may include one or more of: one or more midsole elements, one or more insole elements, one or more innersole boards, one or more outsole elements, one or more impact-attenuating column members, one or more mechanical type impact-attenuating members, one or more fluid-filled bladders, etc. Sole structures designed for any desired sport, athletic activity, or other activity or use may be included as part of the footwear structure 1000 without departing from this invention.

The upper member 1002 may be engaged with the sole structure 1004 in any desired manner without departing from this invention, including in manners that are conventionally known and used in the art. Such methods may include, for example, the use of cements or adhesives; the use of sewing or stitching; the use of fusing techniques; the use of mechanical connectors; etc.

As described above, the upper member 1002 may include a fabric or other upper material 1002*a* (e.g., a spacer mesh fabric element as described above), in one or more separate pieces, including thin and/or lightweight upper materials that typically are not able to stably support a seam on their own. The upper member 1002 further may include the seam support material 1002*b*, in one or more separate pieces, e.g., of the types described above. As shown in the figures, in addition to providing a support material for supporting an abutting edge joint seam (such as seams 1006, 1008, and 1010 utilizing zig-zag stitches), the support material 1002*b* may be provided at other locations where support is desired, such as along the edges of the foot-receiving opening 1012, in the toe area 1014, along the lace eyelet areas 1016 and 1018, as at least part of the tongue member 1020, in the heel area 1022, etc. Moreover, if the seam support material 1002*b* is colored and/or textured different from the upper fabric material 1002*a*, the seam support material 1002*b* may be provided on the upper material 1002*a* in a manner so as to provide an interesting aesthetic design for the upper. For example, if desired, one or more openings may be provided in the seam support material 1002*b* (such as opening 1024), and the opening(s) may be shaped so as to form a design, pattern, logo, alphanumeric character, or the like (e.g., due to the upper material 1002*a* (or another material) showing through the opening 1024 provided in the seam support material). As another example, one or more pieces 1026 of seam support material 1002*b* (or another material) may be provided on the upper material 1002*a*, in desired shape(s) and location(s) so as to form a design, pattern, logo, alphanumeric character, or the like. Other ways of decorating the article of footwear 1000, including conventional decorative ways, may be used without departing from this invention.

As mentioned above, a separate tongue member (made of the same or different materials from the remainder of the upper member) may be provided and attached to the upper construction without departing from this invention. Alternatively, if desired, a tongue member 1020 may be integrally formed as part of the upper member construction. As best illustrated in FIG. 10C, in this example structure 1000, the tongue member 1020 is integrally formed with at least a portion of the medial side 1030 of the upper construction. Specifically, the tongue member 1020 integrally extends from the medial side eyelet area 1018, and it is joined to the upper structure along seam 1008. In order to allow a conventional shoe lace to be engaged with the upper 1002, the medial side eyelet area 1018 includes two eyelet holes 1032 at each lace engagement location (one in which the free end of the lace enters and one in which the free end of the lace exits), whereas the lateral side eyelet area 1016 includes a single eyelet hole 1032 at each lace engagement location. Alternatively, if desired, the tongue member 1020 could be integrally formed from the lateral side 1034 of the article of footwear 1000 or from the toe portion 1036 of the article of footwear 1000.

As shown in FIG. 10C, the tongue member 1020 may constitute multiple pieces joined together (e.g., at seam 1010), wherein the various pieces of the tongue member form parts of different pieces of the upper material. Other tongue constructions, including single piece tongue constructions that are integrally formed with or separate from the remainder of the upper member, are possible without departing from this invention.

C. Conclusion

Articles of footwear in accordance with at least some examples of this invention may include structural elements or other components that are not specifically described above or illustrated in the figures. Such elements or components may include, but are not necessarily limited to: heel counters or other support members; shoe laces or other securing members; toe caps; connectors for engaging the footwear to a foot; arch support members; orthotics; other support members (in the sole or the upper); etc. Also, the footwear may be made in any desired style, including athletic footwear, dress footwear, low rise footwear, high top footwear, etc.

At least some example structures according to this invention provide a lightweight, breathable material with strong, smooth seam structures. The ability to form seams in the manners described above allows a footwear producer to pattern the pieces of upper material around the last, which can help give the upper material a better shape without having to excessively stretch the material around the last. If desired, the upper material could be shaped directly on the last and/or better tailored to fit around the last. As yet additional options, if desired, the seam(s) may be made while the upper material component(s) is (are) on the last. These features can help provide a very comfortable final upper structure.

Also, given the benefit of this disclosure, one skilled in the art could readily apply aspects of this invention to production of other articles of manufacture, such as other articles of apparel. For example, this invention could be used for producing seams in hats, gloves, shirts, pants, shorts, socks, athletic wear (e.g., uniforms or apparel for specific sports), and the like.

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

I claim:

1. A textile component, comprising:

a first material element having a first edge, wherein the first edge includes a first portion of material engaged with a first seam support material via a first thermoplastic material;

a second material element having a second edge, wherein the second edge includes a second portion of material engaged with a second seam support material via a second thermoplastic material, wherein the second thermoplastic material may be the same as or different from the first thermoplastic material, wherein the second seam support material may be the same as or different from the first seam support material, wherein an edge of the first seam support material abuts an edge of the second seam support material, and wherein the first seam support material is confined to a strip adjacent to the first edge leaving a third portion of material exposed; and means for engaging the first edge and the second edge in an abutting edge joint.

2. The textile component according to claim 1, wherein the means for engaging the first edge and the second edge includes a sewn seam, and wherein a thread material of the sewn seam is at least partially melted, concealed, or masked.

3. The textile component according to claim 2, wherein the thread material is sewn through the first seam support material and the second seam support material.

4. The textile component according to claim 1, wherein the first edge aligns with the edge of the first seam support material and an edge of the first portion of material, and wherein the second edge aligns with the edge of the second seam support material and an edge of the second portion of material.

5. The textile component according to claim 1, wherein the first thermoplastic material comprises a first material, and the second thermoplastic material comprises the first material, wherein the first seam support material comprises a second material, and the second seam support material comprises the second material, and wherein the first material is different from the second material.

6. The textile component according to claim 1, wherein the first thermoplastic material is different from the second thermoplastic material, and wherein the first seam support material is different from the second seam support material.

7. The textile component according to claim 1, wherein the first material element is on a separate piece of material from the second material element.

8. The textile component according to claim 1, wherein the first material element and the second material element are provided on a single piece of material.

9. The textile component according to claim 1, wherein the first material element is a spacer mesh material.

10. The textile component according to claim 1, wherein each of the first material element and the second material element is a spacer mesh material.

11. A textile component, comprising:

a first material element having a first edge, wherein the first edge includes a first portion of material engaged with a first seam support material via a first thermoplastic material;

a second material element having a second edge, wherein the second edge includes a second portion of material engaged with a second seam support material via a second thermoplastic material, wherein an edge of the first seam support material abuts an edge of the second seam support material, wherein the first seam support material is confined to a strip adjacent to the first edge leaving a third portion of material exposed; and a thread material engaging the first edge and the second edge in an abutting edge joint with a sewn seam.

12. The textile component according to claim 11, wherein the first edge aligns with the edge of the first seam support material and an edge of the first portion of material, and wherein the second edge aligns with the edge of the second seam support material and an edge of the second portion of material.

13. The textile component according to claim 11, where the thread material is sewn through the first seam support material and the second seam support material.

14. The textile component according to claim 11, wherein the thread material of the sewn seam is at least partially concealed or masked.

15. The textile component according to claim 11, wherein the sewn seam has a zig-zag stitch structure.

16. The textile component according to claim 11, wherein the first thermoplastic material comprises a first material, and the second thermoplastic material comprises the first material, wherein the first seam support material comprises a second material, and the second seam support material comprises the second material, and wherein the first material is different from the second material.

17. The textile component according to claim 11, wherein the first thermoplastic material is different from the second thermoplastic material, and wherein the first seam support material is different from the second seam support material.

18. The textile component according to claim 11, wherein the first material element is on a separate piece of material from the second material element.

19. The textile component according to claim 11, wherein the first material element and the second material element are provided on a single piece of material.

20. The textile component according to claim 11, wherein the thread material of the sewn seam is at least partially melted.

* * * * *